United States Patent [19]

Myers

[11] 3,973,853

[45] Aug. 10, 1976

[54] HAND HELD AEROSOL CAN APPLICATION

[75] Inventor: Gene Edward Myers, Miami, Fla.

[73] Assignee: Lawrence Peska Associates, Inc., New York, N.Y. ; a part interest

[22] Filed: May 29, 1975

[21] Appl. No.: 581,869

[52] U.S. Cl. ..... 401/190; 401/287

[51] Int. Cl.[2] ..... A46B 11/02

[58] Field of Search ..... 401/287, 190; 239/280; 222/174, 391

[56] References Cited

UNITED STATES PATENTS

| | | | |
|---|---|---|---|
| 1,465,856 | 8/1923 | Marsh | 401/287 |
| 3,229,859 | 1/1966 | Conroy et al. | 222/174 |
| 3,612,706 | 10/1971 | Verga et al. | 401/287 X |
| 3,861,566 | 1/1975 | Wentzell | 222/174 |

*Primary Examiner*—Stanley H. Tollberg
*Assistant Examiner*—Norman L. Stack, Jr.
*Attorney, Agent, or Firm*—Jack D. Slobod

[57] ABSTRACT

An applicator for an aerosol can includes a hair brush having a head and a handle. An aerosol can is secured to the back of the hair brush head and a mechanical linkage carried by the hair brush for depressing the aerosol can push button includes a lever pivotly mounted to and making an acute angle with the handle. A portion of a flexible tube inserted into the push button nozzle runs between the hair brush bristles and is provided with dispensing apertures.

3 Claims, 2 Drawing Figures

HAND HELD AEROSOL CAN APPLICATION

FIELD OF THE PRESENT INVENTION

The present invention relates generally to applicators for spraying the contents of aerosol cans between hair brush bristles or comb teeth. In its particular aspects the present invention relates to an applicator for an aerosol can including an actuating lever running along and making an acute angle with a handle for the applicator.

BACKGROUND OF THE INVENTION

Many preparations are currently available in aerosol cans for dyeing, tinting or stripping hair. Generally after spraying onto the hair, these preparations must be evenly dispersed throughout the hair utilizing either the hands, a comb or a brush. These preparations could be applied with little waste if an applicator were available including a comb or brush having nozzles for spraying the preparation located between the brush bristles or the comb teeth.

While various applicators including combs or brushes have been proposed for aerosol cans, they have suffered from two deficiencies. One deficiency has been the requirement of accepting only a specially configured aerosol container. A second deficiency is that the actuating means for the aerosol has generally required that the applicator be gripped in an awkward manner.

OBJECTS OF THE PRESENT INVENTION

It is an object of the present invention to provide an applicator including a comb or brush which will accept standard aerosol cans.

It is a further object of the present invention to provide an aerosol applicator which is controlled and manipulated with a natural grip such as in holding an ordinary hairbrush.

SUMMARY OF THE INVENTION

Briefly the aforementioned and other objects of the present invention are satisfied by providing an applicator including a hairbrush handle grip. An open cradle formed on the back of a hairbrush head provides space for carrying a conventional large aerosol container in a manner not influencing the grip of the applicator.

The actuating mechanism for depressing the push button on the aerosol can includes a lever pivotly mounted to and making an acute angle to the handle. The lever is actuated by a natural grip with a hand encircling both the handle and the lever.

The conventional aerosol can is further accommodated by a small diameter tube which is inserted into the nozzle on the push button of the can. The tube is trained between the bristles of the hairbrush and includes spaced apart apertures for dispensing the contents of the aerosol can.

Other objects, features and advantages of the present invention will become apparent upon perusal of the following detailed description of the preferred embodiment thereof when taken in conjunction with the appended drawing wherein.

DETAILED DESCRIPTION

Figure 1:
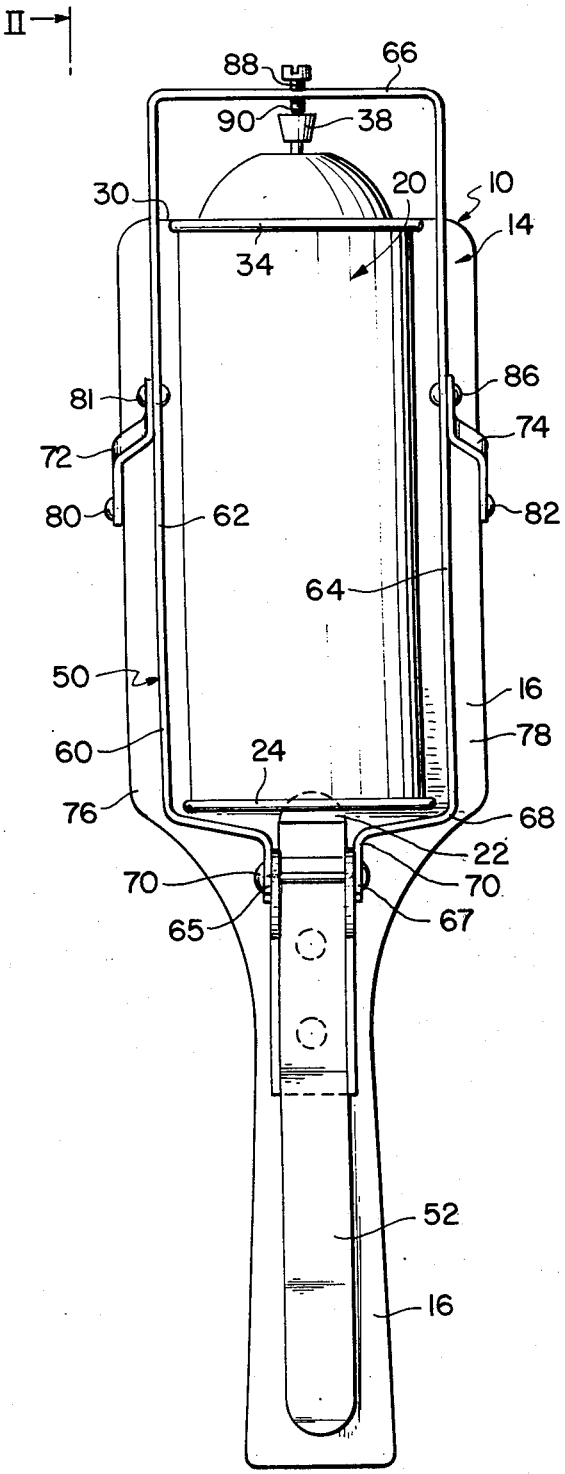
FIG. 1 is a rear view of the applicator of the present invention.
Figure 2:
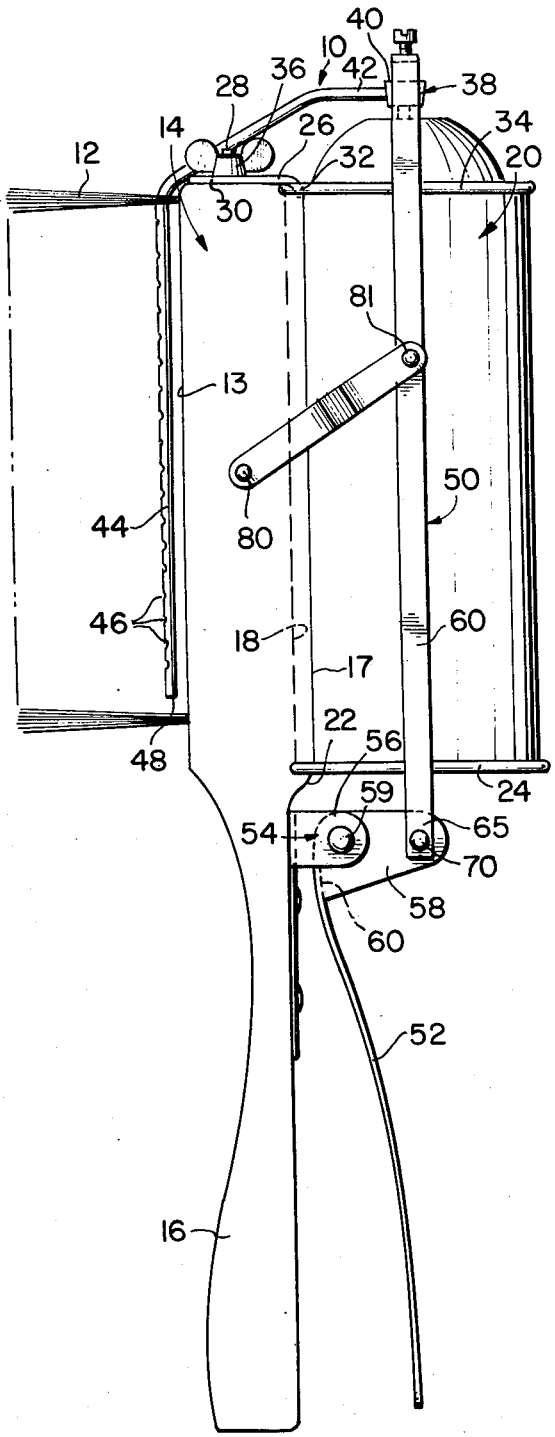
FIG. 2 is a side view of the applicator in FIG. 1.

Referring to FIGS. 1 and 2, the principles of the present invention are preferably utilized in connection with an applicator 10 having upstanding hair brush bristles 12 on the front face 13 of a broad head portion 14 of the applicator. It should be understood that comb teeth (not shown) might also be provided on head portion 14 instead of or in conjunction with bristles 12.

Extending from head portion 14 is an elongated handle portion 16. The head portion 14 and handle portion 16 are configured in general as those of an ordinary hair brush to provide a natural grip and use of the applicator 10.

Along the back surface 17 of head portion 14 there is formed an elongated cylindrical well serving as a cradle for receiving the side of a standard aerosol can 20 containing dye, tint, stripper or hair spray. Aerosol can 20 is secured in cradle well 18 by a camming protrusion 22 upstanding angularly from back surface 17 near the beginning of handle portion 16, and locking behind the usual toroidal head 24 on the bottom of can 20. Further for locking the can 20 in place, there is provided a sheet metal dog 26 carried on a stud 28 from an end surface 30 of head portion 14. Dog 26 includes an arcuate end 32, which is locked behind the usual toroidal bead 34 near the top of can 20, by fastening the dog tightly against surface 30 with a wingnut 36 on stud 28.

Thus the conventional cylindrical push button 38 on can 20 above bead 34, which operates a valve within the can, has its nozzle aperture 40 positioned above surface 30. To convey the effluent from nozzle 40 to be sprayed between and along bristles 12, a flexible tube or conduit 42 has one end inserted into nozzle 40. Tube 42 passes over end surface 30 and terminates in a portion 44 lying along front surface 13 of the head portion between bristles 12. Tube portion 44 includes plural spaced apart apertures 46 along its length for discharging the effluent from can 20 between and along the bristles 12 and into the hair. Tube portion 44 is further provided at its end with a plug 48.

For depressing the push button valve and nozzle means 38 while maintaining a normal and comfortable grip on handle 16 a mechanical linkage 50 is provided which includes an actuating lever 52 pivotly mounted in a yoke 54 secured to the top of handle 16 and extending along and making an acute angle with the handle. The lever 52 is angled with respect to handle 16 to provide space for the hand to encircle just handle 16. When it is desired to spray the contents of aerosol can 20, the hand encircles both the handle 16 and lever 52, to squeeze and rotate lever 52 toward the handle.

The lever 52 is a sheet metal strip having a pair of 90° folded tabs 56 forming a bar in linkage 50. The yoke 54 comprises a sheet metal member secured to the back of handle 16 which includes a pair of 90° folded tabs 56 between which tabs 58 are set. A pin 59 is received through both pairs of tabs 56 and 58 near the fold line 60 of tabs 58.

A second bar in linkage 50 comprises a sheet metal member bent into a rectangular frame 60. Frame 60 comprises a pair of spaced apart parallel legs 62 and 64 extending along opposite sides of can 20 and a connecting leg 66 lying perpendicularly between legs 62 and 64 and passing directly over push button 38. The respective ends 65 and 67 of legs 60 and 62 opposite connecting leg 66 are bent toward each other at 68 and then bent parallel to their original orientations at 70 on opposite sides of the far ends of the spaced apart tabs 58. A pin 70 is passed through the ends 65 and 67 of frame 60 and through tabs 58.

A third bar member of linkage 50 comprises a pair of links 72 and 74, having first ends rotatably secured respectively to opposite side surfaces 76 and 78 of head portion 14 with pins 80 and 82. The opposite ends of links 72 and 74 are rotatably secured to an intermediate position along the respective legs 62 and 64 with pins 84 and 86.

It will now be understood that linkage 50 which includes a base link comprising the head portion 14 and handle portion 16, is a type of four bar linkage which moves connecting leg 66 generally downward against the top of push button 38 in response to rotation of lever 52 toward handle 16.

For accommodating a tolerance in the height of aerosol can 20, a set screw 88 threaded through connecting leg 66 bears on push button 38. Set screw 66 may be rotated to adjust the position of its bearing end 90 with respect to pushbutton 38 so that end 90 just rests on top of the pushbutton when lever 52 is not squeezed.

Having described the preferred embodiment of the present invention in great detail, it should be apparent that numerous modifications, additions, and omissions in the details thereof are possible within the intended spirit and scope of the invention. Hence, the following claims define the scope of the invention.

What is claimed is:

1. An applicator apparatus for an aerosol can having a top mounted valve and nozzle means said applicator comprising a head portion merging into an elongated handle portion, said head portion having a front face carrying plural upstanding members selected from the group consisting of comb teeth and brush bristles, said head portion having a back surface, opposite said front face, forming a cradle for said aerosol can, aperture means on said front surface between said upstanding members, conduit means having one end connected to said aperture means and having an opposite end adapted to be connected to said valve and nozzle means, and linkage means including a lever extending along said handle portion and making an acute angle therewith for depressing said valve and nozzle means in response to angular movement of said lever.

2. The apparatus of claim 1 further comprising means carried by said linkage means for bearing on said valve and nozzle means, and means for adjusting the position of said bearing means with respect to said aerosol can without movement of said lever.

3. The apparatus of claim 1 wherein said conduit means comprises a flexible tube, said aperture means being formed by holes in the tube wall spaced apart along a portion of the length of the tube.

* * * * *